US005355798A

United States Patent [19]

Yoder, Jr.

[11] Patent Number: 5,355,798

[45] Date of Patent: Oct. 18, 1994

[54] INTERMITTENT MOTION ROTARY PRINTING PRESS

[76] Inventor: Donald E. Yoder, Jr., 3610 Holly Rd., Dover, Pa. 17315

[21] Appl. No.: 150,847

[22] Filed: Nov. 12, 1993

[51] Int. Cl.[5] ..... B41F 13/24; B41F 13/34

[52] U.S. Cl. ..... 101/247; 101/235; 101/245

[58] Field of Search ..... 101/22, 235, 245, 247, 101/182, 219

[56] References Cited

U.S. PATENT DOCUMENTS

| | | | |
|---|---|---|---|
| 3,081,697 | 3/1963 | Delligatti | 101/235 |
| 3,260,193 | 7/1966 | Mann | 101/235 |
| 4,397,237 | 8/1983 | Makosch | 101/247 |
| 4,523,522 | 6/1985 | Fischer | 101/247 |
| 4,747,347 | 5/1988 | McAnelly | 101/227 |
| 5,031,532 | 7/1991 | Walther | 101/351 |
| 5,224,422 | 7/1993 | Marozzi et al. | 101/228 |
| 5,230,284 | 7/1993 | Kelm | 101/247 |

*Primary Examiner*—Edgar S. Burr
*Assistant Examiner*—Lynn D. Hendrickson
*Attorney, Agent, or Firm*—Charles J. Long

[57] ABSTRACT

An intermittent motion rotary printing press in which the inking cylinder and pressure cylinder are mounted in spaced apart relation on a single common bracket assembly which pivots between an inking step position and a print step position. The range of bracket assembly pivot motion is adjustable to define a first stop point at which the inking cylinder transfers ink to a printing plate and a second stop point at which the pressure cylinder confines a web in printing contact with the printing plate. One or more pneumatic cylinders operate to shift the bracket assembly between first and second stop points and hold the assembly at the selected stop point for inking or printing operations respectively.

4 Claims, 6 Drawing Sheets

INTERMITTENT MOTION ROTARY PRINTING PRESS

BACKGROUND OF THE INVENTION

1. Field of the Invention

This invention relates to rotary printing presses. More particularly, the invention relates to intermittent motion rotary printing presses for printing on one side successive definite lengths of a continuous flexible web. The invention has particular utility with flexographic presses, but also relates to other rotary presses, such as offset presses.

2. Description of the Prior Art

Rotary presses are commonly used to print continuous flexible webs. Such presses generally include an inking cylinder, a print cylinder and a pressure cylinder, all mounted for rotation about parallel horizontal axes. In operation the rotating inking cylinder surface picks up printing ink from a suitable supply source and transfers it by surface contact to a printing plate mounted on and forming a part of the surface of the print cylinder, which is rotating at the same surface speed but in opposite direction to the inking roll. The printing plate, which contains the raised letters or design to be applied to the web, can be formed from rigid curved metal plates which conform to the print cylinder, or it can be a flexible mat of rubber or the like which is adhered to the print cylinder magnetically or with appropriate adhesives.

The web is printed by advancing it past the inked surface of the rotating printing plate at a speed equal to the surface speed of rotation of the plate, while using the pressure cylinder to confine the web in printing contact with the printing plate.

In continuous printing operations, such as where a pattern is printed uninterruptedly on a web, the three cylinders rotate concurrently, the inking cylinder remaining in inking contact with the printing plate and the pressure cylinder confining the web in printing contact with the plate, while the web is advanced through the press without pause. However, many printing operations involve printing of successive definite lengths of web in separate steps, with web travel stopped between each printing step; for these operations, intermittent motion presses are used.

In most intermittent motion presses, the step of inking the printing plate by the inking cylinder is done prior to and independently of the step of printing the web; i.e. the inking step is done while web travel is stopped between printing steps. Such presses are constructed and arranged so that during inking the pressure cylinder and web are moved away from the printing plate, allowing the print cylinder to rotate for inking; for the ensuing printing step, the inking cylinder is moved away from the printing plate and the pressure cylinder moved into position to confine the web in printing contact with the plate. Generally, the inking cylinder continues to rotate in contact with the ink supply whether or not it is in contact with the printing plate, in order to keep fresh ink on its surface.

Web advancement in intermittent motion presses can be accomplished in several ways. In an internally powered arrangement, which is the most common, the print cylinder and pressure cylinder are powered for rotation by means within the press, one cylinder often being driven by the other which is in turn rotated by the power means, and the web is frictionally "pinched" between either the print and pressure cylinders or a pair of powered "nip and pinch" rolls and advanced when they rotate during the print step. In an externally powered arrangement, the web is pulled through the press by advancing means separate from and downstream of the press, and its travel path causes it to frictionally contact enough of the pressure cylinder surface so that during the print step the web rotates the pressure cylinder, and generally also the print cylinder which is suitably linked to the pressure cylinder. A third arrangement combines the first two—i.e. external power means advance the web and help to rotate the pressure and print cylinders while means within the press impart supplementary rotational power to one or both of the print and pressure cylinders.

Intermittent motion presses of the type described must include means for separating the pressure cylinder and printing plate during each inking step and for bringing them back into proper web-confining relationship during each printing step. Such presses likewise must include means for maintaining proper inking contact between the inking cylinder and printing plate during each inking step and for separating them during each printing step. Heretofore several approaches to these requirements have been used.

One approach is to maintain the pressure and inking cylinders stationary and mount the print cylinder on shiftable means whereby the printing plate can be moved between positions in or out of contact with one or both of the inking and pressure cylinders; Walther U.S. Pat. No. 5,031,532 discloses such an arrangement, although for a continuous press. This approach, however, often requires complex mechanisms and controls to provide precision in positioning the print cylinder in relation to the pressure cylinder for proper print quality. Additionally, it does not provide as much rigidity of print cylinder mounting as is the case when the print cylinder can be mounted in fixed supports.

A second approach to cylinder positioning in intermittent motion presses has been to mount one or both of the inking and pressure cylinders on separate shiftable supports which are independently moved between inking step and printing step positions by appropriate means; McAnelly U.S. Pat. No. 4,747,347 discloses a press in which the pressure cylinder is moved in this manner, although no provision is made in that patent for motion of the inking cylinder. Here the problem is also one of complexity of construction, since two separate systems must be used for both mounting and moving the cylinders and for accurately controlling the pressure each exerts on the print cylinder or web, as applicable, when in contact therewith.

Marozzi et al. U.S. Pat. No. 5,224,422 discloses yet another approach to the problem of cylinder positioning. In this approach the inking cylinder and pressure cylinder are mounted on diametrically opposite sides of the print cylinder and the printing plate extends less than half way around the print cylinder circumference, whereby whenever the plate is in contact with one of the pressure and inking cylinders it is out of contact with the other. With this approach all three cylinders can remain in fixed positions since separation is accomplished by the geometry of the system. However, the Marozzi, et al. approach limits the length of pattern which can be printed on the web to at most half the circumference of the print cylinder; if longer patterns are required, the printing plate length must be extended circumferentially around the print cylinder and the mechanism becomes one where at least one of the print or inking cylinders must be shifted between two positions during operation of the unit.

SUMMARY OF THE INVENTION

I have found that improved operation, simplicity of construction and ease of control can be secured in an intermittent motion press by mounting the inking cylinder and the pressure cylinder in spaced apart relation on a common bracket assembly which pivots between an inking step position and a print step position.

In accordance with the invention, I provide an intermittent motion rotary printing press for printing on one side successive definite lengths of a continuous flexible web advanced through the press from a source of supply upstream of the press, the web having a print receiving side and a non-printed side, in a process wherein motion of the web is stopped after each of said successive lengths has been printed and is resumed when the following successive length is to be printed, said press being of the type comprising an inking cylinder, a print cylinder having a printing plate attached to and covering a portion of its surface, and a pressure cylinder, all of which cylinders are mounted for rotation with their longitudinal axes substantially parallel and horizontally positioned, wherein the improvement comprises a bracket assembly on which both the pressure cylinder and inking cylinder are rotatably mounted in spaced apart relation, said bracket assembly being mounted for pivoting movement about a horizontal pivot axis between a first stop point at which the inking cylinder makes ink transferring contact with the printing plate and the pressure cylinder is spaced from the print cylinder, and a second stop point at which the inking cylinder is spaced from the print cylinder and the pressure cylinder confines the web in printing contact with the printing plate; adjusting means for independently varying the location of the first and second stop points; and means for moving the bracket assembly between the first and second stop points and for holding the assembly at the first stop point during an inking step in which the print cylinder and inking cylinder rotate at equal surface speeds in directions opposite one another and ink is applied to the printing plate from the inking cylinder, and at the second stop point during a printing step in which one of said successive definite lengths of the web is advanced at a predetermined speed and is printed by the inked printing plate as the print cylinder rotates at a surface speed equal to the predetermined web speed.

Preferably, the printing plate has a leading edge and a trailing edge, the leading and trailing edges being respectively the first and last parts of the plate to contact the web as the print cylinder rotates during the printing step, and the press includes means responsive to completion of the printing step for causing the bracket assembly moving means to move the bracket assembly from the second stop point to the first stop point after the trailing edge of the printing plate has passed the inking cylinder but before the leading edge of the printing plate has again reached the inking cylinder.

In an externally powered embodiment the press includes linking means operative during the printing step to link the pressure cylinder to the print cylinder in such manner that rotation of the former in one direction causes corresponding rotation of the latter in the opposite direction and at equal surface speed, and means for causing the web to travel through the press along a path in which the non-printed side of the web is maintained in frictional contact with the pressure cylinder to an extent sufficient to rotate both the pressure cylinder and print cylinder when the web advances during a printing step, both the pressure cylinder and print cylinder being otherwise unpowered during said step.

In an especially useful externally powered embodiment, the printing plate has a predetermined thickness, the pressure cylinder surface is coated with a material selected from the group consisting of Buna-N rubber and other materials with substantially equivalent compressibility and frictional properties, and the linking means comprises a bearer strip affixed to the print cylinder surface adjacent to and substantially circumferentially co-extensive with the printing plate, the bearer strip being of a material selected from the group consisting of natural rubber and other materials with substantially equivalent resilience and frictional properties, the bearer strip having a thickness from about 0.003 inches to about 0.010 inches greater than the thickness of the printing plate, whereby when the bracket assembly is at the second stop point the bearer strip is compressed to provide frictional forces enabling the rotating pressure cylinder to rotate the print cylinder during the printing step.

Other details, objects and advantages of the invention will become apparent as the following description of a certain present preferred embodiment thereof proceeds.

BRIEF DESCRIPTION OF THE DRAWINGS

In the accompanying drawings I have shown a present preferred embodiment in which.

DESCRIPTION OF THE PREFERRED EMBODIMENT

Figure 1:
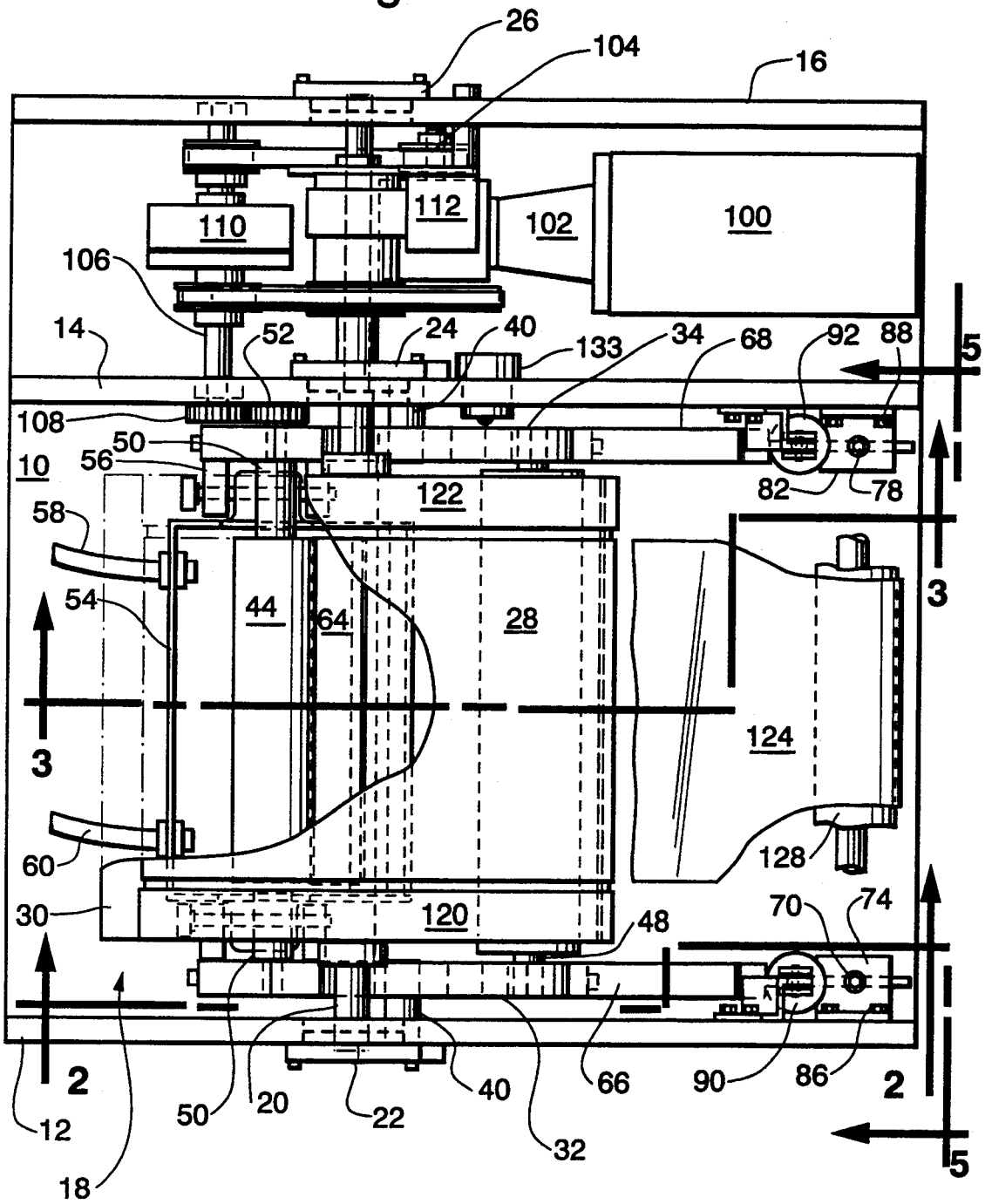
FIG. 1 is a top plan view of a printing press according to the invention, with the print cylinder broken away to show the ink fountain, doctor blade and inking roll below, and with the web and its guide rolls broken away for simplification.

Referring to the drawings generally, there is shown a rotary printing press of the invention. The press comprises a frame consisting of a horizontal base plate 10 with three spaced apart vertical support plates 12, 14 and 16 affixed thereto. A print cylinder 18 is positioned between support plates 12 and 14. Print cylinder 18 includes an axle 20 positioned on the cylindrical axis; the ends of axle 20 extend outwardly from the cylinder body. Bearings 22, 24 and 26 attached to support plates 12, 14 and 16 respectively and aligned with bores in the support plates, receive print cylinder axle 20 and support it in a horizontal position for rotation. A printing plate 28 is attached to and covers a portion of the surface 30 of print cylinder 18.

Positioned on either side of print cylinder 18 between the cylinder and the adjacent support plates 12 and 14 respectively are parallel side members 32 and 34 comprising a bracket assembly. Stub axles 40 extending outwardly from side members 32 and 34 define a pivot axis for the bracket assembly.

Bores in support plates 12 and 14 and bearings 42, attached to the support plates and concentric with the bores, receive the stub axles 40 and pivotally support the bracket assembly on a horizontal pivot axis below the print cylinder 18.

Figure 2:
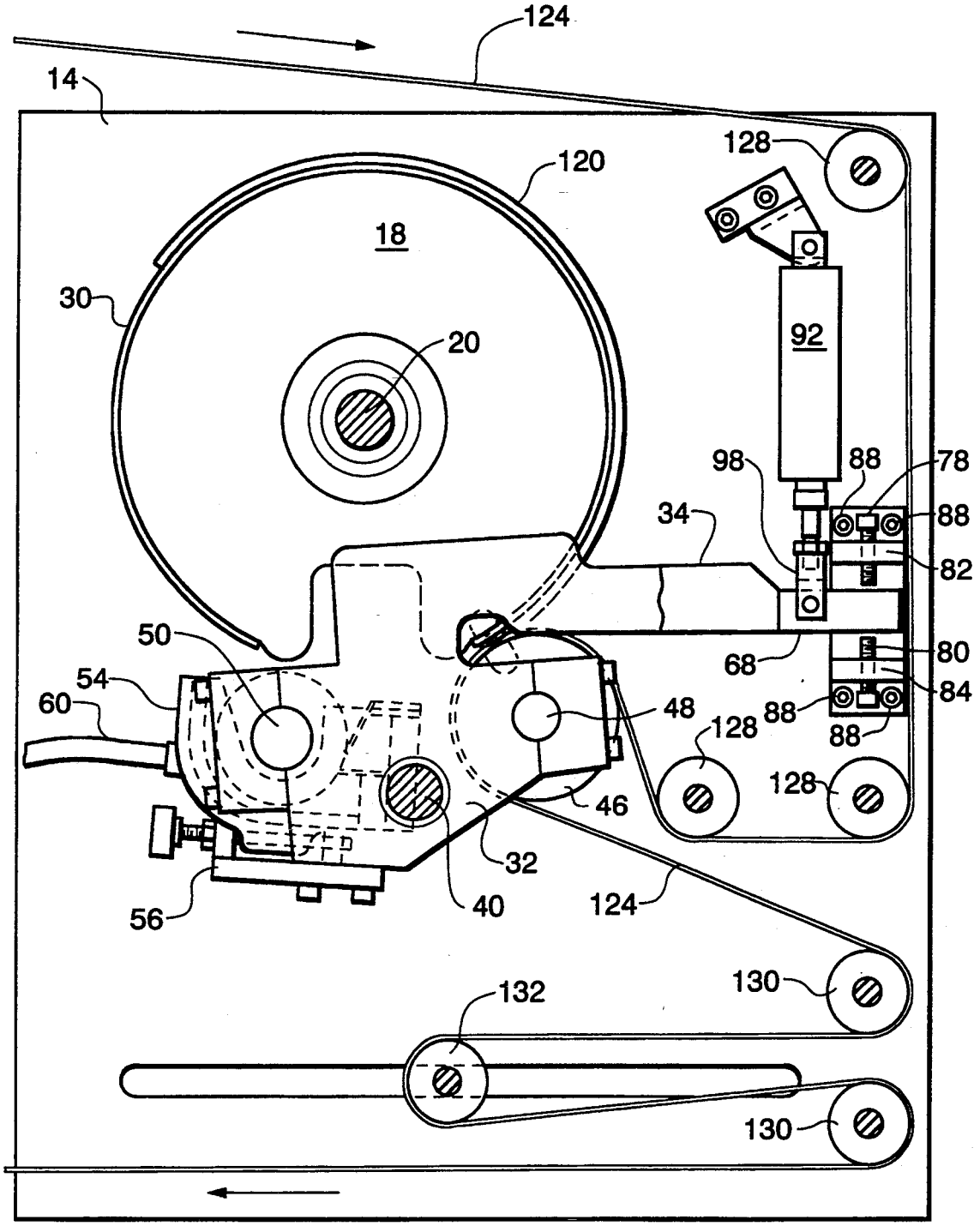
FIG. 2 is a vertical sectional view taken on line 2—2 of FIG. 1.

An inking cylinder 44 and pressure cylinder 46 are mounted between and supported by the bracket assembly side members 32 and 34 with their axes horizontal and spaced apart on opposite sides of the bracket assembly pivot axis. Pressure cylinder 46 has a central axle 48 with ends extending outwardly from the cylinder body; the extending axle ends are clamped in position in the bracket assembly side members as shown in FIG. 2, and internal bearings allow the cylinder body to rotate about its axis. The inking cylinder 44 likewise has a central axle 50, but in this case the outwardly extending ends of the axle are journalled for rotation in bearings in side members 32 and 34; additionally, a portion of one end of axle 50 extends beyond side member 34 and has a drive gear 52 attached thereto.

The locations of inking and pressure cylinders 44 and 46 in the bracket assembly is such that when the bracket assembly is positioned to bring the surface of inking cylinder 44 in inking contact with the printing plate 28, the pressure cylinder 46 is spaced from the print cylinder, and when the bracket assembly is pivoted to bring pressure cylinder 46 in printing relationship to print cylinder 18 the inking cylinder is spaced from the print cylinder.

A trough-shaped ink fountain 54 is mounted between the bracket side members 32 and 34 and supported by screw clamp fixtures 56, attached to the bracket side members, in a position such that the lower portion of inking cylinder 44 is submerged in ink held by the fountain. Ink is circulated through fountain 54 from an ink supply, not shown, by conventional pump means, not shown, via inlet and outlet hoses 58 and 60 respectively. The surface finish of the inking cylinder is such that it picks up ink from the fountain and applies it to the surface of the printing plate as both the inking cylinder and the printing plate rotate in surface contact during an inking step; the mechanics and physical details of inking cylinders are known and within the skill of the art. In the embodiment shown, inking cylinder 44 rotates counterclockwise viewing FIGS. 2, 3 and 4, and in order to ensure uniformity of ink pick-up by the inking cylinder surface, a prewipe blade 62 and a doctor blade 64 are mounted in the fountain for coarse and fine removal respectively of excess ink from the cylinder surface; the prewipe and doctor blades are preferably formed from UHMW plastic such as TEFLON®, although other materials could be used within the skill of the art.

Figure 5:
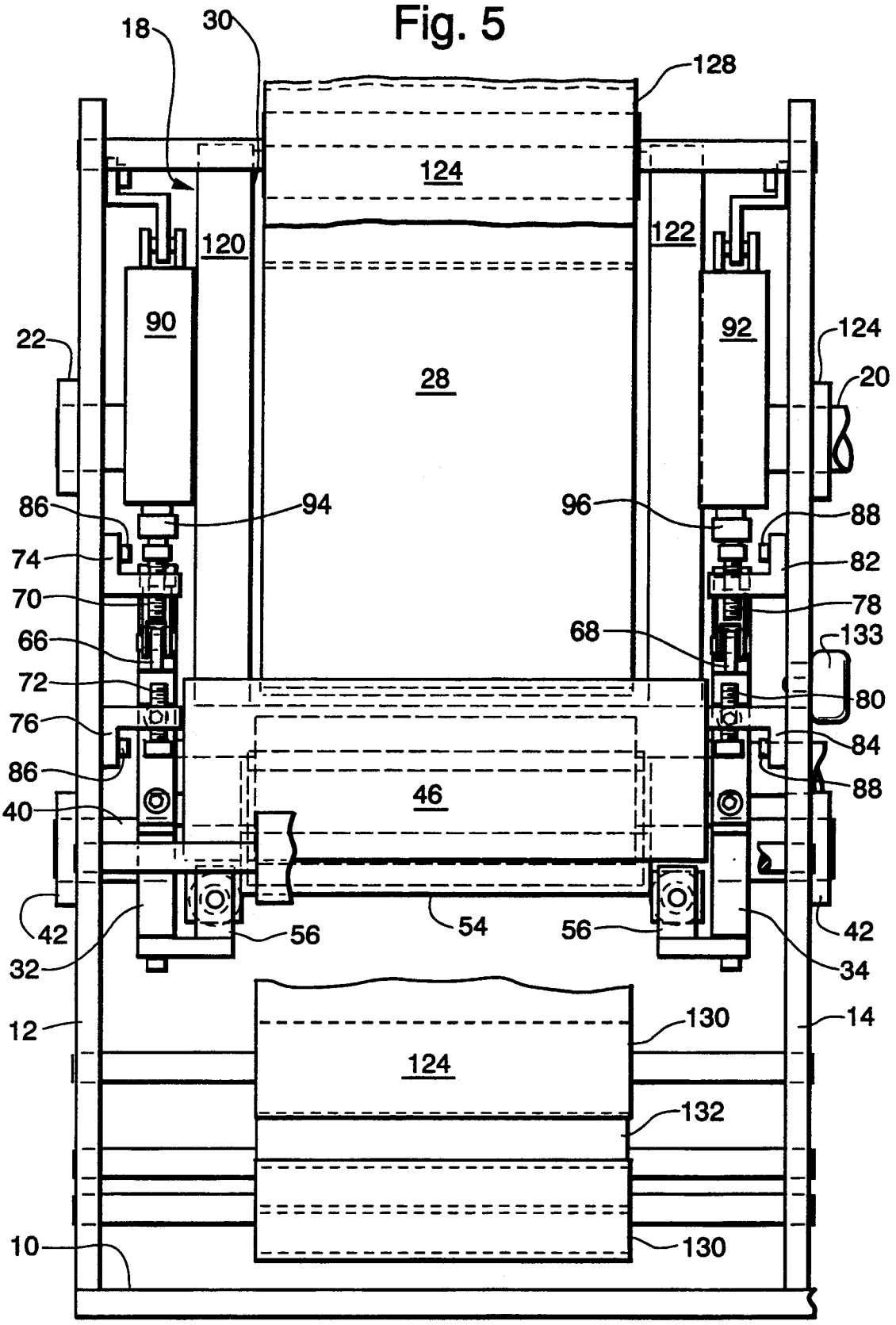
FIG. 5 is a partial vertical elevational view of one end of the press taken on line 5—5 of FIG. 1, with the web and its guide rolls in the foreground broken away.

Side members 32 and 34 of the bracket assembly are shaped identically and include elongated fingers 66 and 68 extending towards the rear of the press, i.e. to the right viewing FIGS. 1 and 2. The distal end of each finger is positioned between the inwardly extending legs of upper and lower L-shaped brackets fastened to the adjacent frame member; a set screw threaded through a hole in each bracket leg has its end extending toward the finger, and adjustment of the set screws provides means for independently fixing the upper and lower limits of vertical finger motion and thus the arc through which the bracket assembly can pivot. Thus, as most clearly shown in FIG. 5, set screws 70 and 72 threaded respectively in brackets 74 and 76 are used to fix stop points on the motion of finger 66, and set screws 78 and 80 threaded respectively in brackets 82 and 84 are used to fix stop points on the motion of finger 68. Brackets 74 and 76 are attached to support plate 12 by bolts 86, and brackets 82 and 84 are attached to support plate 14 by bolts 88. In practice, corresponding pairs of set screws, i.e. 70–78 and 72–80, are set such that the respective upper and lower stop points are at the same positions for both fingers 66 and 68, to ensure that the axes of inking cylinder 44 and pressure cylinder 46 are parallel to the axis of print cylinder 18 at both ends of the bracket assembly pivot range.

Means for moving the bracket assembly between the stop points at either end of its pivot range and holding the assembly at either stop point are provided by pneumatic cylinders 90 and 92 which are attached respectively to support plates 12 and 14 at their cylinder ends and to fingers 66 and 68 at their piston ends. In use, compressed air supplied to cylinders 90 and 92 causes their pistons 94 and 96 to extend or retract and thereby move the bracket assembly to one of its two stop points and hold it in such position until the air flow is reversed, at which time the cylinder shifts the assembly to its other stop point. Obviously, the pneumatic cylinders must be selected to have a range of piston travel greater than the range of travel of the fingers between stop points. Attachment at the piston ends is by the convention expedient of providing a clevis 98 with its closed end threaded onto the piston end and its open end straddling the finger; a pin inserted through holes in the open end of the clevis and a corresponding hole in the finger attaches the clevis to the finger.

A power train assembly is mounted between support plates 14 and 16 for driving the inking cylinder and print cylinder as necessary. The assembly includes an electric drive motor 100 connected to a gear reducer 102 the output shaft 104 of which powers a belt drive to turn a drive shaft 106 journalled in support plates 14 and 16. A gear 108 at the inside end of drive shaft 106 meshes with the gear 52 on the adjacent end of inking cylinder 46 to provide rotation thereof. Also attached to drive shaft 106 is a magnetic drive clutch 110 connected by a belt drive to an indexing clutch 112 attached to the axle 20 of print cylinder 18.

With further respect to print cylinder 18, it comprises an aluminum body, with a layer of steel or other ferromagnetic film on the external shell forming the cylinder surface 30. A cut-out portion at 114 allows access to the interior of the cylinder and to means, not shown, for holding the exterior steel foil, which is ordinarily applied as a separate sheet, against the aluminum body. For simplicity, the end portions of the steel foil sheet extending from the aluminum shell into the cylinder are not shown in the drawing figures.

Printing plate 28 is magnetically attached to the surface 30 of print cylinder 18. In the preferred embodiment, the printing plate is typically about 1/8" thick and includes three layers held together by appropriate adhesives, namely, a top layer about 0.090" thick of flexible photopolymer sheet impression material, i.e. the material carrying the actual artwork to be printed, a thin central layer about 0.005" thick comprising a coating of steel or other relatively inelastic material, and a bottom layer about 0.030" thick of flexible and resilient magnetic material such as PLASTIFORM® magnetic plate backing supplied by Arnold Engineering of Norfolk, Nebr., which magnetically adheres to the print cylinder surface. The printing plate has a leading edge 116 and a trailing edge 118, a length at least sufficient for the length of the artwork to be printed but generally no greater than about 80% of the circumference of the print cylinder, and a maximum width in the range of 80% of the print cylinder width; obviously, the dimensions of print cylinder 18 must be sufficient to accommodate the maximum size printing plate required for a particular application of the press.

Attached to the print cylinder surface on either side of printing plate 28 are bearer strips 120 and 122 which are circumferentially co-extensive with the printing plate. I generally employ two bearer strips as shown, and prefer to make them from natural rubber, although a single strip could function satisfactorily in some cases and material other than natural rubber but with equivalent resilience and frictional properties, for reasons to be discussed, could be used for bearer strips. Separate bearer strips can be glued or otherwise attached to the print cylinder surface as in the embodiment shown; alternatively, and sometimes preferably, I may extend the width of the bottom layer of the printing plate 28 to the full print cylinder width and attach the bearer strips to that material, thereby forming a unitary flexible magnetically attached member which includes both printing plate 28 and bearer strips 120 and 122. Regardless of how they are formed and applied, the overall thickness of the bearer strips above the print cylinder surface is preferably from about 0.003" to about 0.01" greater than the overall thickness of printing plate 28.

For proper inking of printing plate 28 the inking surface of inking cylinder 44 must be wide enough to span the full width of the printing plate but not so wide as to contact the surface of either of the bearer strips.

The surface of pressure cylinder 46 is preferably coated with Buna-N rubber, although other materials with substantially equivalent compressibility and frictional properties could be used. Such coating provides the pressure cylinder surface with a coefficient of friction sufficient to both drive the print cylinder when the pressure cylinder is in compressive contact with the natural rubber bearer strips and prevent slippage when the pressure and print cylinders are being driven by the moving web during printing, as discussed below.

As shown in FIG. 2, a continuous flexible web 124 to be printed on one side in successive definite lengths is advanced from a supply source, not shown, through the press along a travel path defined by a first series of guide rolls 128 rotatably journalled in support plates 12 and 14, the pressure cylinder 46, and a second series of guide rolls 130, including a registration roll 132, all likewise rotatably journalled in support plates 12 and 14, and then out of the press to the next operation, which may typically be a form, fill and seal packaging machine in which the printed web sections are applied as cover sheets for filled containers. The press embodiment shown is externally powered, i.e. the web is advanced through the press by means, not shown, acting thereon outside and downstream of the press; typically the advancing means comprise powered rolls in the packaging machine which pinch the web and rotate to pull it through the press.

Guide rolls 128 and 130 constitute means causing the web to travel through the press along a path in which the non-printed side of the web is in frictional contact with the surface of pressure cylinder 46 over roughly two-thirds of the cylinder's circumference. Generally this extent of contact is sufficient to cause the advancing web to rotate both the pressure cylinder and the print cylinder during a printing step, although greater or lesser contact may be needed in some applications.

A fiber optic probe 132 is mounted in a bore in support plate 14 in position such that the probe will sense the presence or absence of bearer strip 122 at the point of contact between the web 124 and the printing plate 28. The function of probe 132 is discussed in more detail below.

Figure 8:
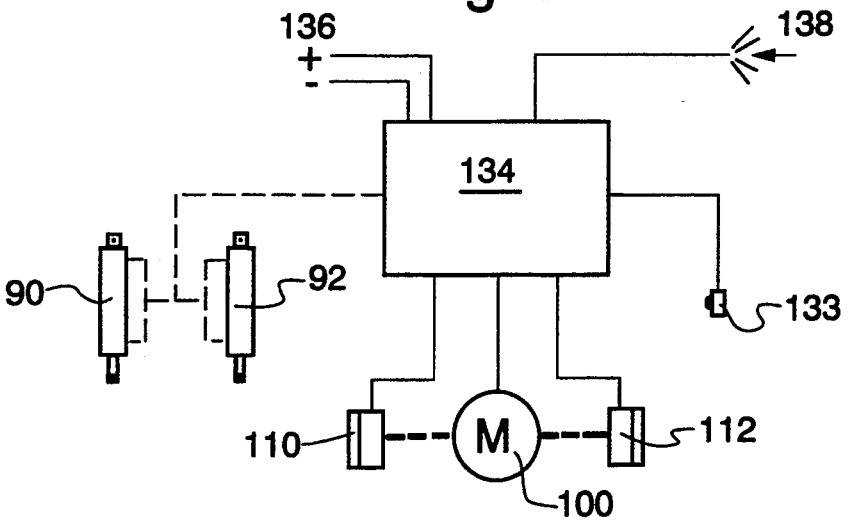
FIG. 8 is simplified schematic control diagram for the press.

FIG. 8 shows a simplified schematic diagram of the electric and pneumatic circuitry of the press, which includes a control box 134 connected to a suitable source of electricity 136 and containing necessary timers, relays, etc.; the control box 134 operates through suitable electric and pneumatic connections to control the press operation, as described below.

Figure 3:
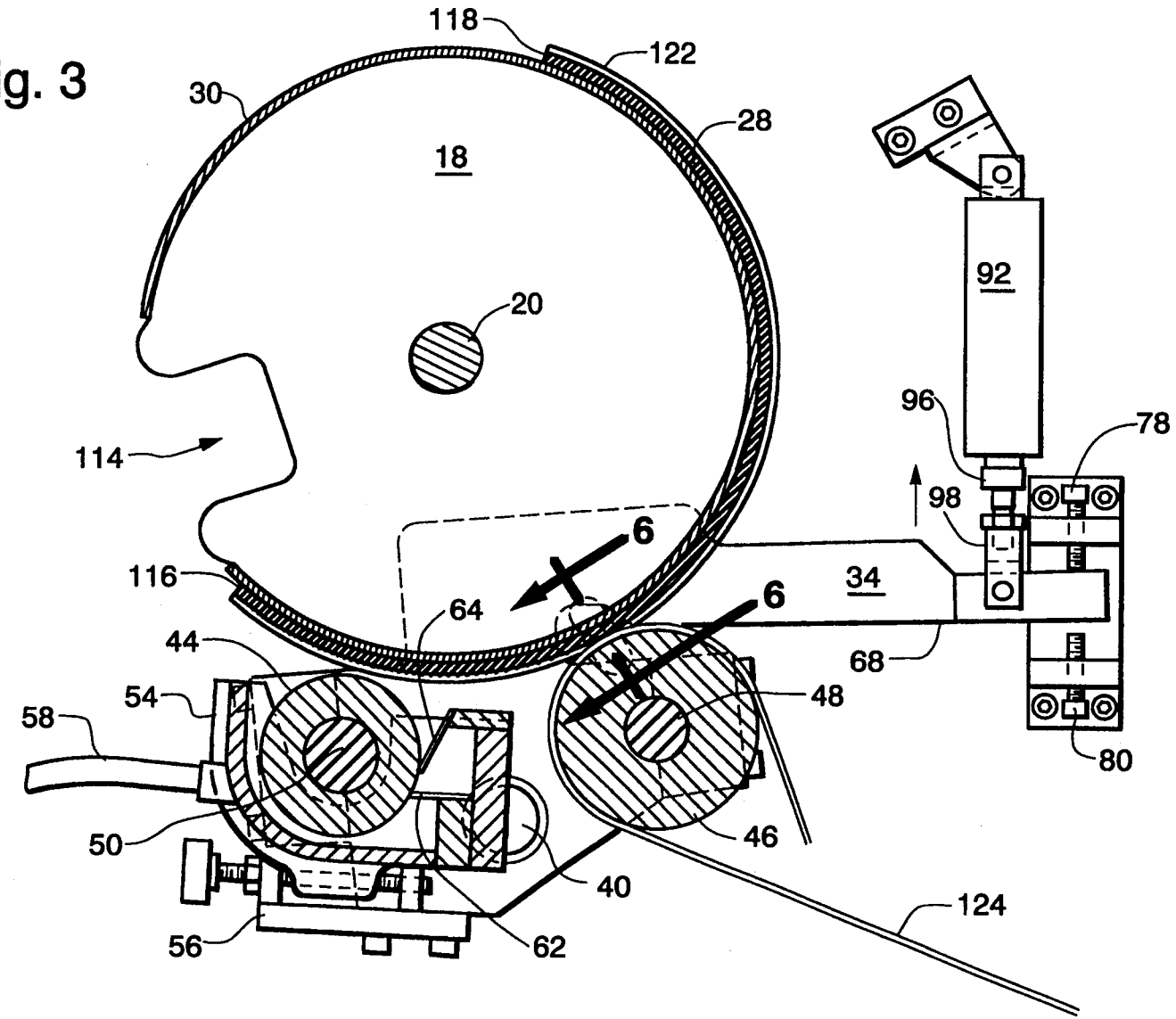
FIGS. 3 and 4 are enlarged detail sectional views taken on 3—3 of FIG. 1, with FIG. 3 showing the bracket assembly in the printing position and FIG. 4 showing the bracket assembly in the inking position.
Figure 4:
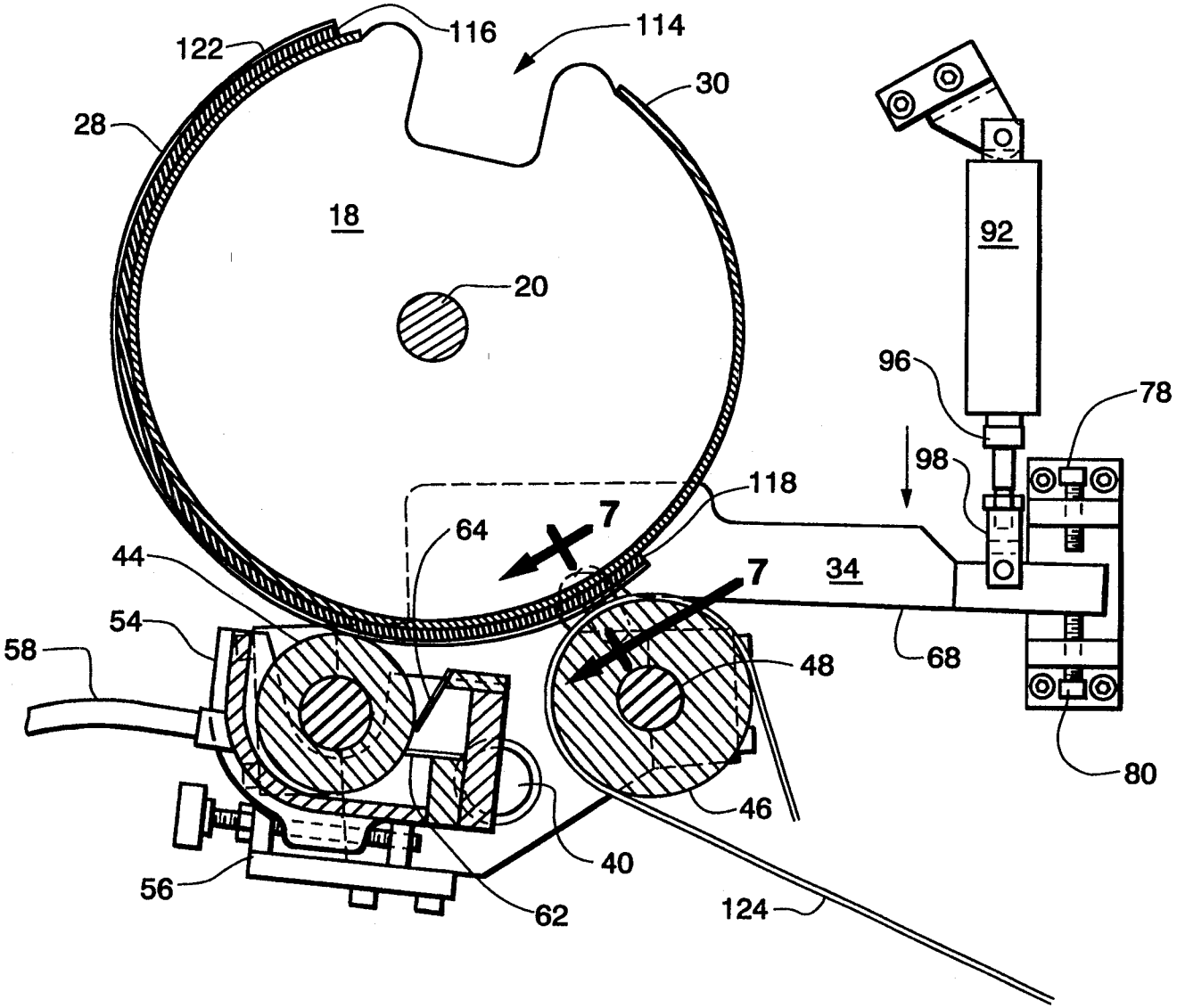
Figure 6:
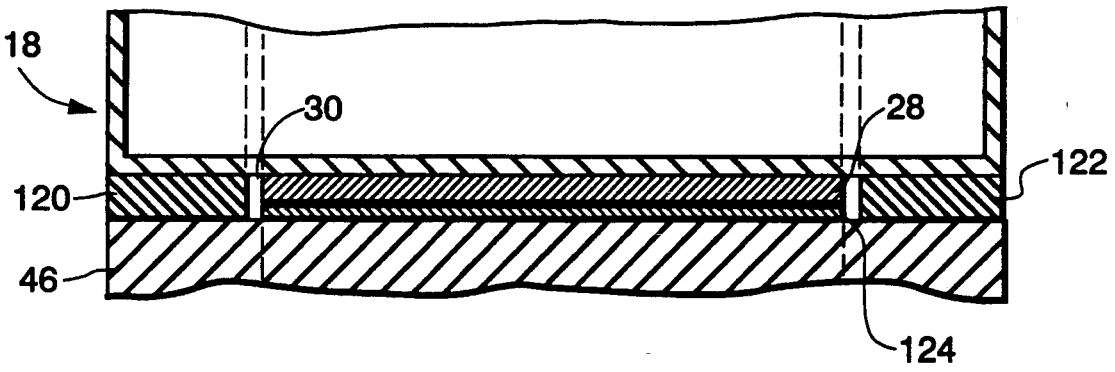
FIG. 6 is an enlarged detail view taken on line 6—6 of FIG. 3.
Figure 7:
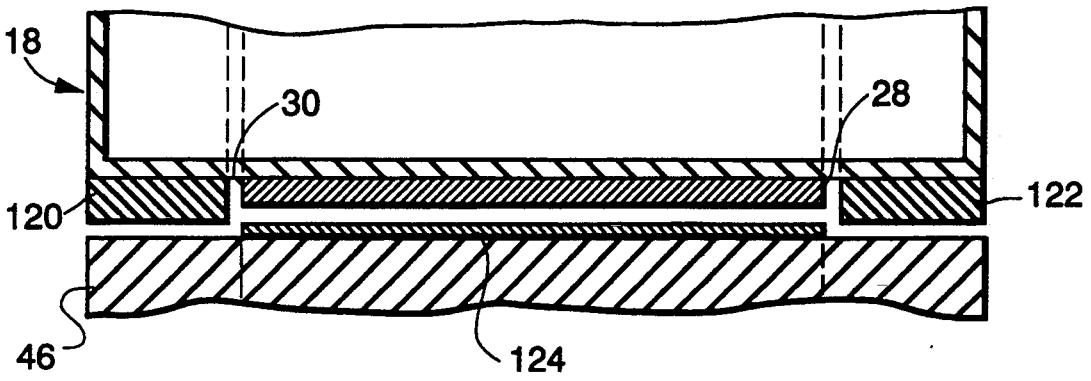
FIG. 7 is an enlarged detail view taken on line 7—7 of FIG. 4.

Operation of the press proceeds as follows, assuming that printing is being done in conjunction with a form, fill and seal packaging machine located downstream of the press and including pulling means for intermittently advancing the web through the press in successive definite lengths which are ultimately sealingly applied by the packaging machine to formed and filled packages:

With web 124 having been threaded through the press around guide rolls 128, pressure cylinder 46 and guide rolls 130–132, the lower set screws 72 and 80 in brackets 76 and 84 are set to define a first or lower stop point for the bracket assembly, at which the pressure cylinder 46 is spaced from the print cylinder 18 and the inking cylinder 44 makes ink transferring contact with the printing plate 28 when the printing plate passes over the inking cylinder. FIG. 4 shows the bracket assembly at its first stop point and FIG. 7 shows a cross section of the printing cylinder 18, pressure cylinder 46 and web 124 at the first stop point of the bracket assembly. Next set screws 70 and 78 in brackets 74 and 82 are set to define a second or upper stop point for the bracket assembly at which inking cylinder 44 is spaced from print cylinder 18 and pressure cylinder 46 confines the web 124 in printing contact with the printing plate 28 when the printing plate passes over the pressure cylinder. FIG. 3 shows the bracket assembly at its second stop point and FIG. 6 shows a cross section of the print cylinder, pressure cylinder and web at the second stop point. It is to be noted that at the second stop point the outer portions of pressure cylinder 46 bear on and slightly compress the bearer strips 120 and 122; this combination serves as linking means between the print cylinder 18 and pressure cylinder 46 whereby rotation of the pressure cylinder in one direction caused by movement of the web 124 causes corresponding rotation of the print cylinder in the opposite direction and at equal surface speed to produce smudge-free impressions on the web.

In operation of the press shown in the drawing figures, the web travel is in the direction of the arrows in FIG. 2; viewing the same figure, print cylinder 18 rotates in a clockwise direction and inking and pressure cylinders 44 and 46 rotate counterclockwise.

The operational cycle of the press is as follows, beginning at an initial condition and time just prior to the printing step, at which time the printing plate 28 is wet with ink, pneumatic cylinders 90 and 92 are retracted to hold the bracket member 36 at its second stop point and cause the web to be confined in printing relationship between the pressure cylinder 46 and printing plate 28, drive motor 100 is rotating the inking cylinder 44 with the doctor blades 62 and 64 scraping excess ink from the inking cylinder, the indexing clutch 112 is engaged to prevent rotation of print cylinder 18, and the magnetic drive clutch 110 is disengaged so that the print cylinder is not receiving any rotational power from the drive train:

An electric signal 138 is given from the form, fill and seal packaging machine indicating that it is about to index, i.e. advance a definite length of web for printing and package application. Upon receiving that signal, the control box 134 signals a relay to release the indexing clutch 112 which will allow print cylinder 18 to rotate through only one revolution. The downstream packaging machine then pulls the web 124 through the press, thereby rotating pressure cylinder 18. Bearer strips 120 and 122 provide friction drive through which the rotating pressure cylinder 46 rotates the print drum 18 to cause printing of the web 124.

The printing step is completed when the trailing edge of printing plate 28 passes the point of contact between it and web 124; since, as above mentioned and as shown in FIGS. 3 and 4, the trailing edge of the bearer strips 120 and 122 coincide with the trailing edge of printing plate 28, the trailing edges of the bearer strips pass the contact point at the same time. Fiber optic probe 132 is aligned with the web/printing plate contact point and connected to a proximity switch to sense the presence or absence of bearer strip 122 at the web/printing plate contact point; when the printing step is completed, the probe and switch respond to the absence of the bearer strips and cause a signal to be sent engaging magnetic drive clutch 110 and rotating print drum 18 through the balance of one revolution from the starting position, at which point indexing clutch 112 stops the print drum, although the magnetic drive clutch remains engaged. At the same time the probe and proximity switch signal a series of relay timers in the control box 134. After a predetermined delay time to allow the trailing edge 118 of the printing plate to move past the inking cylinder 44, the timers a) activate pneumatic controls in control box 134 to extend the pneumatic cylinders 90 and 92 thereby shifting the bracket assembly 36 to its first stop point and holding it in that position, and b) release indexing clutch 112 to allow the drive clutch 110 to rotate print cylinder 18 through one revolution during which the inking cylinder 44 makes ink transferring contact with the printing plate 28, whereby the printing plate is reinked. The indexing clutch stops print cylinder rotation at the end of one revolution, and at that time pneumatic and electric controls in the control box cause the pneumatic cylinders 90 and 92 to retract to shift bracket assembly 36 to its second position again and to disengage the magnetic drive clutch 110, which returns the press to its initial condition and completes the operation cycle. Subsequent signals from the form, fill and packaging machine initiate subsequent operational cycles to print successive lengths of the web.

Presses in accordance with the invention are simple in construction and highly adaptable. The preferred fiber optic control arrangement illustrated herein, the bracket assembly mounting of the inking and pressure cylinders, and the operation cycle in which inking is done on one revolution of the print cylinder and printing is done on a second revolution of the print cylinder, combine to allow the use of printing plates of differing lengths, from very short to the full usable circumference of the print cylinder. With magnetic mounting of the plates on the cylinder, changes in printing plates can be made quickly and easily; as long as printing plates of the same thickness are used the only other change required with a change in printing plate is a change to bearer strips of length equal to the new plate length, and if a unitary structure is used having both printing plate and bearer strips on a common substrate, as above discussed, the change to a different printing plate is essentially a one-step operation, with no further adjustment of bracket assembly pivot range or the like required.

While I have shown and described a present preferred embodiment of the invention it is to distinctly understood that the invention is not limited thereto but may be otherwise variously embodied within the scope of the following claims.

I claim:

1. An intermittent motion rotary printing press for printing on one side successive definite lengths of a continuous flexible web advanced through the press from a source of supply upstream of the press, the web having a print-receiving side and a non-printed side, in a process wherein motion of the web is stopped after each of said successive lengths has been printed and is resumed when the following successive length is to be printed, said press being of the type comprising an inking cylinder, a print cylinder having a printing plate attached to and covering a portion of its surface, and a pressure cylinder, all of which cylinders are mounted for rotation with their axes substantially parallel and horizontally positioned, wherein the improvement comprises:

a. a bracket assembly on which both the pressure cylinder and inking cylinder are rotatably mounted in spaced apart relation, said bracket assembly being mounted for pivoting movement about a horizontal pivot axis between a first stop point at which the inking cylinder makes ink transferring contact with the printing plate and the pressure cylinder is spaced from the print cylinder, and a second stop point at which the inking cylinder is spaced from the print cylinder and the pressure cylinder confines the web in printing contact with the printing plate;

b. adjusting means for independently varying the location of the first and second stop points; and c. means for moving the bracket assembly between the first and second stop points and for holding the assembly at the first stop point during an inking step in which the print cylinder and inking cylinder rotate at equal surface speeds in directions opposite one another and ink is applied to the printing plate from the inking cylinder, and at the second stop point during a printing step in which one of said successive definite lengths of the web is advanced at a predetermined speed and is printed by the inked printing plate as the print cylinder rotates at a surface speed equal to the predetermined web speed.

2. A press as claimed in claim 1 in which the printing plate has a leading edge and a trailing edge, the leading and trailing edges being respectively the first and last parts of the plate to contact the web as the print cylinder rotates during the printing step, said press further including means responsive to the completion of the printing step for causing the bracket assembly moving means to move the bracket assembly from the second stop point to the first stop point after the trailing edge of the printing plate has passed the inking cylinder but before the leading edge of the printing plate has again reached the inking cylinder.

3. A press as claimed in either of claims 1 or 2 further including:

a. linking means operative during the printing step to link the pressure cylinder to the print cylinder in such manner that rotation of the former in one direction causes corresponding rotation of the latter in the opposite direction and at equal surface speed; and b. means for causing the web to travel through the press along a path in which the non-printed side of the web is maintained in frictional contact with the pressure cylinder to an extent sufficient to rotate both the pressure cylinder and print cylinder when the web advances during a printing step, both the pressure cylinder and print cylinder being otherwise unpowered during said step.

4. A press as claimed in claim 3 in which the printing plate has a predetermined thickness, the pressure cylinder surface is coated with a material selected from the group consisting of Buna-N rubber and other materials with substantially equivalent compressibility and frictional properties, and the linking means comprises a bearer strip affixed to the print cylinder surface adjacent to and substantially circumferentially co-extensive with the printing plate, the bearer strip being of a material selected from the group consisting of natural rubber and other materials with substantially equivalent resilience and frictional properties, the bearer strip having a thickness from about 0.003 inches to about 0.010 inches greater than the thickness of the printing plate, whereby when the bracket assembly is at the second stop point the bearer strip is compressed to provide frictional forces enabling the rotating pressure cylinder to rotate the print cylinder during the printing step.

* * * * *